US008151400B2

(12) United States Patent
McCoy

(10) Patent No.: US 8,151,400 B2
(45) Date of Patent: Apr. 10, 2012

(54) TOILET AID FOR HANDICAPPED PERSONS

(76) Inventor: Michael J. McCoy, Laurel, MT (US)

( * ) Notice: Subject to any disclaimer, the term of this patent is extended or adjusted under 35 U.S.C. 154(b) by 0 days.

(21) Appl. No.: 12/799,281

(22) Filed: Apr. 22, 2010

(65) Prior Publication Data

US 2011/0258800 A1 Oct. 27, 2011

(51) Int. Cl.
*A47K 7/08* (2006.01)

(52) U.S. Cl. ..... 15/210.1; 15/150

(58) Field of Classification Search ..... 15/147.1, 15/150, 209.1, 210.1, 229.11, 229.13; 294/99.2, 294/118; 604/1; D7/687
See application file for complete search history.

(56) References Cited

U.S. PATENT DOCUMENTS 128,879 A * 7/1872 Howell ..... 15/150
540,938 A * 6/1895 Adair ..... 7/128
818,465 A * 4/1906 Price ..... 294/8.5
1,596,777 A * 8/1926 Takasumi et al. ..... 30/245
1,913,770 A * 6/1933 Olenik ..... 606/207
2,109,147 A * 2/1938 Grosso ..... 606/205
2,168,497 A * 8/1939 Schupp ..... 15/212
2,484,986 A * 10/1949 Ellinger ..... 15/229.13
2,859,465 A * 11/1958 Golden ..... 15/229.13
D213,194 S * 1/1969 Capps ..... D8/54
3,937,510 A * 2/1976 Lew ..... 294/99.2
4,073,533 A * 2/1978 De brey et al. ..... 294/118
4,103,395 A * 8/1978 Latorella ..... 452/6
5,564,145 A * 10/1996 Goldstein ..... 7/158
5,901,993 A * 5/1999 Lowery et al. ..... 294/7
2004/0093678 A1 * 5/2004 Hart et al. ..... 15/104.94

* cited by examiner

*Primary Examiner* — Randall Chin
(74) *Attorney, Agent, or Firm* — Jacobson & Johnson

(57) ABSTRACT

A device by which a person who is handicapped by physical limitations in performing ordinary cleaning of the anal region after toilet excretion has elongated members which have grips or handles at one end and finger-like tips at the other end and are pivotally attached to one another intermediate the ends so that the user can grasp the handle end and hold toilet tissue between the finger-like pads and move the device horizontally while partly slightly raised above the toilet seat to place the tissue in the anal region and move the device to produce a wiping action and when completed, turn the device to release the used tissue into the toilet bowl. The device can be used in similar fashion to apply medication to the anal-genital region. An embodiment of the invention provides an adjustability feature.

6 Claims, 3 Drawing Sheets

TOILET AID FOR HANDICAPPED PERSONS

FIELD OF THE INVENTION

This invention relates in general to personal hygiene devices or appliances but more specifically is directed toward providing a tool or device or appliance for use by or for a handicapped person to cleanse the anal-genital region after excretion or apply medication through a suitable medium.

DESCRIPTION OF THE PRIOR ART

There are a number of patented toileting assistance devices. U.S. Pat. No. 5,862,564 has a laterally extending handle having a centrally attached elongated rod member suitable to reach the anal excretion area; U.S. Pat. No. 6,689,224 comprises an elongated handle with an end coverable with a wiping medium; U.S. Pat. No. 5,044,040 is similar to the '224 patent but with an angled section; U.S. Pat. No. 6,981,293 has a gooseneck handle which can be attached to different media. All of the foregoing are designed to reach the excretion area or region by placing the device between the legs of the handicapped person while in a sitting position.

SUMMARY OF THE INVENTION

A pair of equal length elongated members are pivotably joined together intermediate their ends in pliers-like fashion and have facing finger-tip heads or pads at one end suitable for grasping a suitable medium, such as toilet tissue or medicine applicator, and have hand operable handles or grips at their other or opposite ends which can be easily operated to bring the heads together to securely grasp toilet tissue or other medium or the like and to separate the heads to release the tissue after use. The elongated members are angled so that the device can be maneuvered to place the heads with the attached medium into the anal-genital excretion area. The device is designed so that the handicapped user can easily manipulate it to insert it horizontally from his or her side under or part way past the buttocks and then bring the heads with toilet tissue or similar into the excretion area and rotate it for wiping or cleaning or applying medication while he or she is raised slightly above the toilet seat. Entire wiping process is controlled primarily with the twist of the wrist with minimal strain on the user's back and joints.

As a further feature, an embodiment of the invention provides an adjustment of the angle of the elongated members. A further feature is that the grips or handle can be spring loaded to insure a more positive release of the used tissue or other medium.

DESCRIPTION OF THE PREFERRED EMBODIMENTS

Initially, it should be pointed out that handicapped person (s) as used herein is not intended to be derogatory or allinclusive in any sense. It is only intended to define those persons who might have a physical impairment that places some physical limitation that burdens their ability to perform certain toilet acts and which the instant invention may help alleviate. Typically, this may include persons with back problems or even obese persons who have difficulty attending to their normal toiletry acts or similar, such as applying medication to the anal-genital region.

Figure 1:
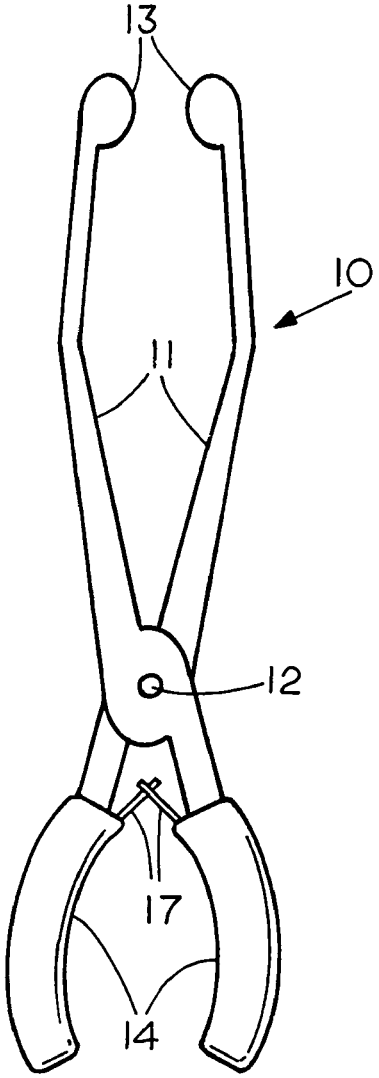
FIG. 1 is a front or plan view of an embodiment of the invention.
Figure 2:
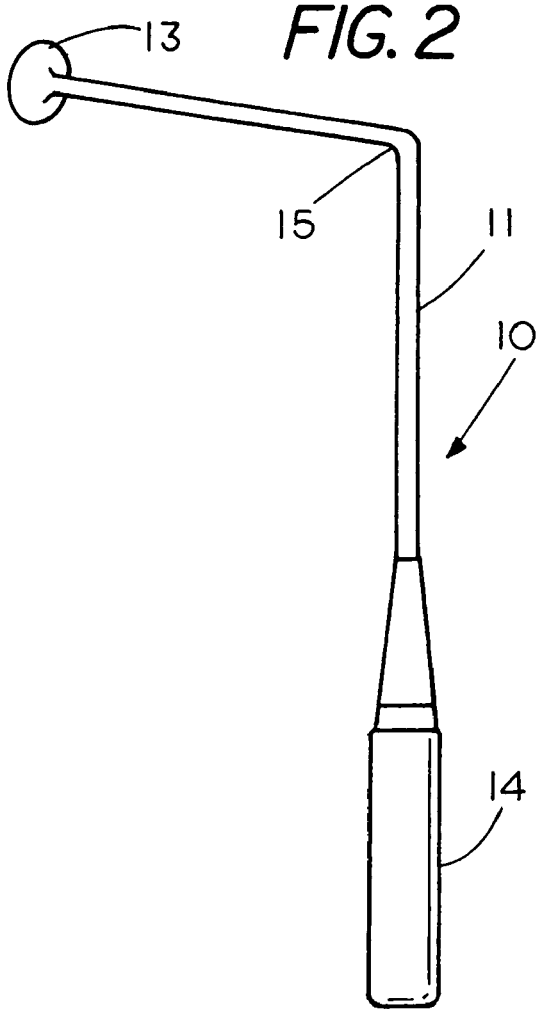
FIG. 2 is a side view.

The embodiment of the invention shown in FIG. 1 and in FIG. 2 identified by reference numeral 10 has a pair of equal length rigid elongated rod like members 11 which are pivotably attached to one another in pliers-like fashion by some conventional means such as by a pivot pin 12 and have inward facing finger-tip heads or pads 13 fixedly attached at one end and each has a grip or handle member 14 attached to the opposite end. As seen most clearly in FIG. 2, elongated members 11 are curved or bent or angled at 15 intermediate the pad end and the pivot attachment at 12. As will be described later in a little more detail, the elongated members 11 are angled at 15 to allow the user to move the pad end of the device, which ordinarily holds the toilet tissue, into the general area of the anus and then turn it to place the tissue into the anal region and rotate the device to produce a wiping motion.

As a feature of the invention, in the embodiment shown in FIG. 1, each of a pair of leaf springs 17 is attached at one end in some convenient or conventional fashion to an associated grip 14 and the leaf springs abut one another at their distal ends and are biased to exert a force to keep grips 14 and their respective handle members apart to keep the head end of the device open, as viewed in FIG. 1. This feature is to ensure that when the user releases the pressure of his or her grip on the handle end after use, the pad or head end of the appliance will open to release the toilet tissue or the like for disposal. The leaf springs is an example of a manner of integrating this feature into the invention. Other types of devices to provide the desired biasing effect are commercially available.

Figure 3:
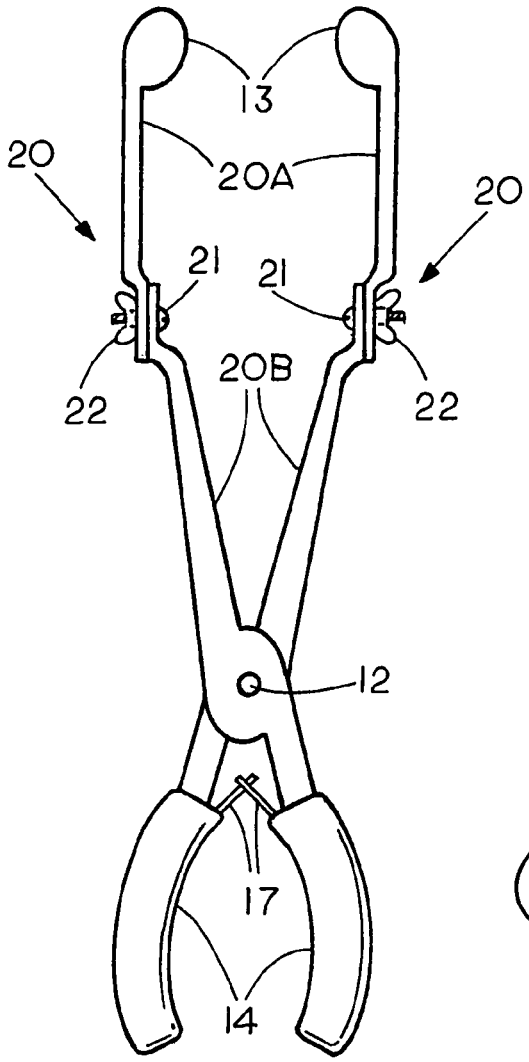
FIG. 3 is a front or plan view of an alternate embodiment of the invention.

FIG. 3 is an illustration of an embodiment of the invention having an adjustability feature. Each of the elongated members 20 comprises an upper section 20A, as viewed in FIG. 3, and a lower section 20 B. Sections 20B are pivotably joined together the same as the elongated members 11 in FIG. 1 by pivot pin 12 and have grips or handle members 14 and leaf springs 17 which are the same and operate the same as the corresponding members shown in FIG. 1. Sections 20A terminate at one end with pads or heads 13 similar to FIG. 1.

The benefit of constructing the invention in the manner as illustrated in FIG. 3 may be multi-fold. For one, it allows the user to adjust the angle of the elongated members to best suit his or her condition. For another, the appliance can be folded up into a more compact condition or disassembled when not in use. Also, the length of the elongated members can be altered if desired by detaching members 20A and replacing them with longer or shorter members or in some other fashion.

A conventional manner of adjustably and/or detachably attaching 20A to 20B is shown in FIG. 3. A conventional adjustable fastener such as screw or bolt 21 passes through suitable apertures (not shown) in the adjoining ends of members 20A and 20B and are releasably secured in place by manually tightening conventional adjustable fasteners such as wing nuts 22. The facing sides of members 20A and 20B at the area of their attachment are smoothed so that the members will be easier to rotate to any desired angle. As mentioned above, wing nuts 22 and bolts 21 can be removed to separate the two sections if desired. For example, it provides means for altering the effective length of the elongated members as mentioned hereinabove.

Figure 4:
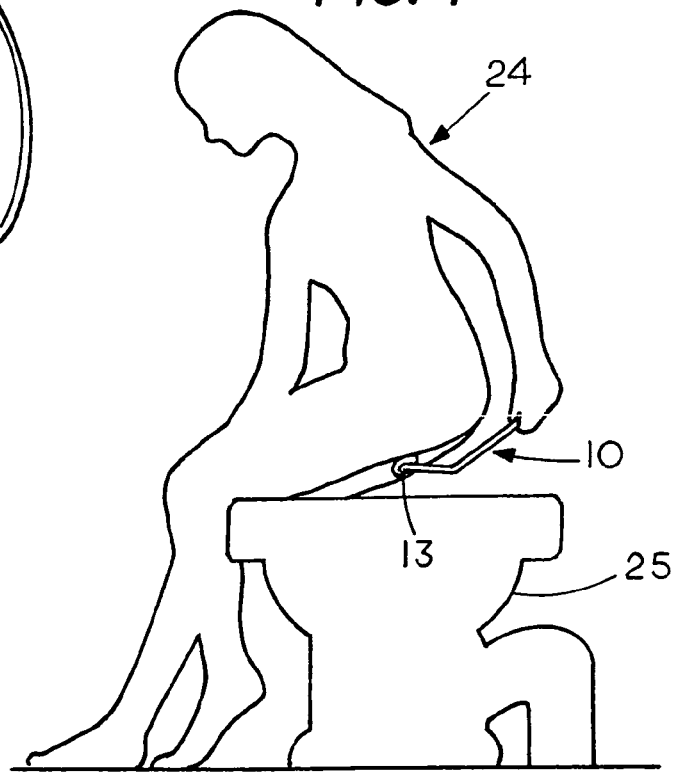
FIG. 4 is a side view illustrating a manner in which the invention may be placed for use by a handicapped person.
Figure 5:
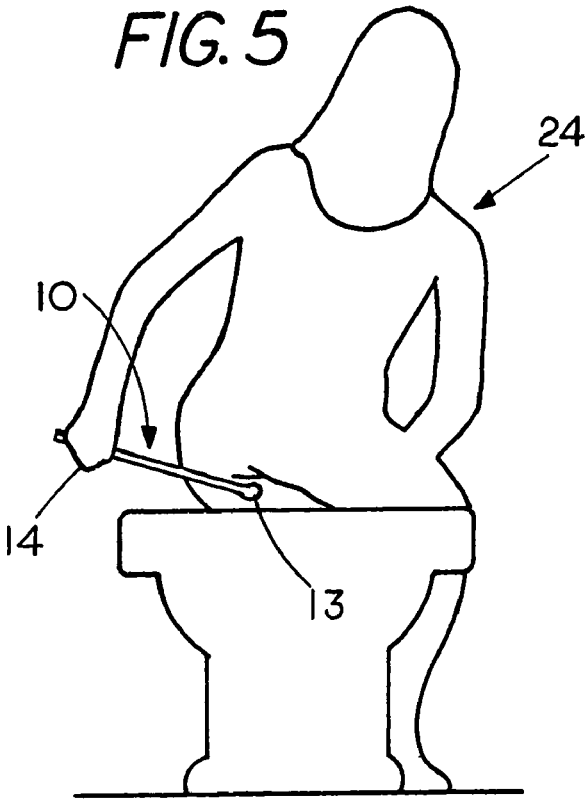
FIG. 5 is a back view of FIG. 4.
Figure 6:
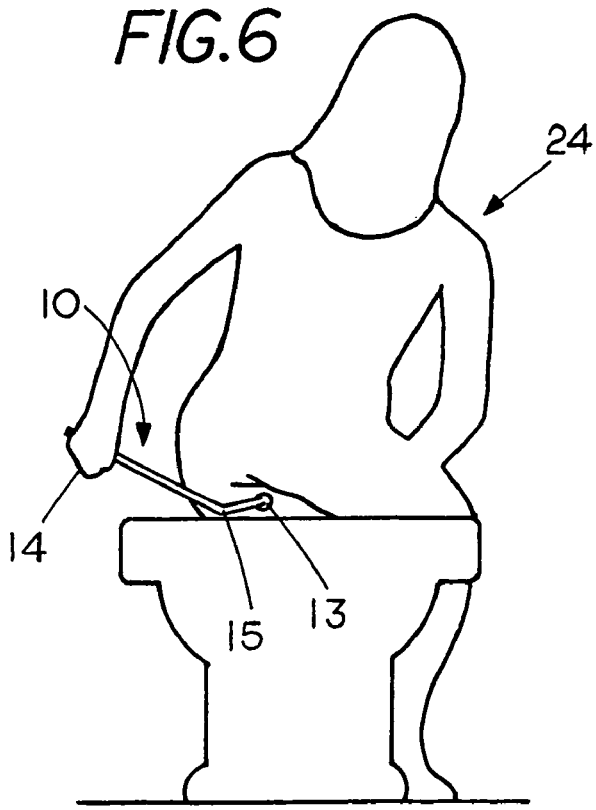
FIG. 6 is a back view further illustrating the manner of use.

In practice, with particular reference to FIGS. 4-6, the user 24, illustrated in silhouette, initially places toilet tissue, or some other medium such as a medicinal applicator, between the separated pads or heads 13 and secures it in place by applying pressure on the grips or handle 14 to bring the pads or heads 13 together to hold the medium securely therebetween. Then, as illustrated somewhat in FIG. 4, the user, while raised only slightly on one side above the seat of a toilet 25, and while still holding the tissue securely between the pads 13, uses a hand to move the appliance horizontally under or partway past the buttock area until the angled part of the device is generally in line with the anal-genital region and then by hand movement turns or otherwise brings the tissue into the anal region and moves the angled portion of the elongated members in a manner to produce a wiping motion and continues until satisfied that the task has been completed to the best of his or her ability. The user then by hand movement turns or rotates the device to bring the tissue over the toilet bowl and then releases the pressure on the grips or handle 14 to allow the heads to separate so that the used tissue is disposed into the toilet bowl.

Although the invention is most beneficial for self-use by a handicapped person and its operation has been described herein in that context, it also can be beneficially used on a handicapped person by the handicapped person's caregiver.

I claim:

1. A toilet aid for a handicapped person, comprising:

(a) a pair of elongated members pivotally engaged with one another in pliers-like fashion and having facing oval shaped fingertip pads at one end and hand operable grips at their opposite ends;

(b) each of said elongated members having a first section extending in a first linear direction from said grips beyond their pivot attachment and a further attached section extending from said first section to said fingertip pads at a substantially ninety degree angle from the linear direction of said first section;

(c) said grips manually operable to pivotally move said elongated members to bring said pads toward one another for holding a medium between said pads and to allow said pads to separate;

(d) said elongated members having a length from said grips to said one end to reach a user's anal-genital region;

(e) said grips manually operable to move said one end of said elongated members into and out of the anal-genital region.

2. A toilet aid for a handicapped person as described in claim 1 wherein said elongated members are spring biased at their pivotal engagement to keep said pads separated.

3. A toilet aid for a handicapped person as described in claim 2 wherein said elongated members are spring biased by a pair of leaf springs, each of said leaf springs having one end attached to a corresponding grip and the distal ends of said leaf springs abutting one another.

4. A toilet aid for a handicapped person as described in claim 1 wherein each of said further sections is pivotally attached to the first section of its elongated member.

5. A toilet aid for a handicapped person as described in claim 1 wherein each of said further sections is removably attached to the first section of its elongated member.

6. A toilet aid for a handicapped person as described in claim 1 wherein said grips are separated from one another when said grips are operated to close together said pads.

* * * * *